US006377736B1

(12) United States Patent
Murphy

(10) Patent No.: US 6,377,736 B1
(45) Date of Patent: Apr. 23, 2002

(54) HELICAL PRODUCTS AND METHOD OF MANUFACTURING OF SAME FOR ENGAGEMENT WITH A CABLE

(75) Inventor: Maurice William Murphy, Freehold, NJ (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/424,103

(22) PCT Filed: May 19, 1998

(86) PCT No.: PCT/GB98/01441

§ 371 Date: Nov. 18, 1999

§ 102(e) Date: Nov. 18, 1999

(87) PCT Pub. No.: WO98/53222

PCT Pub. Date: Nov. 26, 1998

(30) Foreign Application Priority Data

May 23, 1997 (GB) ..... 9710791

(51) Int. Cl.[7] ..... G02B 6/44
(52) U.S. Cl. ..... 385/100; 385/147; 72/137
(58) Field of Search ..... 385/100–114, 147; 72/135–138, 143, 145; 29/173, 456; 138/134, 129

(56) References Cited

U.S. PATENT DOCUMENTS

| | | | | |
|---|---|---|---|---|
| 2,182,342 A | | 12/1939 | Karitzky | |
| 2,230,611 A | | 2/1941 | Coffin et al. | |
| 2,888,726 A | | 6/1959 | Smith | |
| 5,018,825 A | * | 5/1991 | Rowland | 385/101 |
| 5,586,461 A | * | 12/1996 | Murphy | 72/137 |
| 5,927,125 A | * | 7/1999 | Murphy | 72/135 |

FOREIGN PATENT DOCUMENTS

| | | |
|---|---|---|
| GB | 2 234 830 | 2/1991 |
| GB | 2 303 503 | 2/1997 |
| GB | 2 305 303 | 4/1997 |
| GB | 2 308 752 A | 7/1997 |
| GB | 2 314 217 A | 12/1997 |
| WO | WO 96 14176 | 5/1996 |
| WO | WO 98/53222 | 11/1998 |

* cited by examiner

*Primary Examiner*—Phan T. H. Palmer
(74) *Attorney, Agent, or Firm*—Dean W. Russell; Kristin L. Johnson; Kilpatrick Stockton LLP

(57) ABSTRACT

The invention provides a helical device and method of producing same for engagement with a cable, the helical device comprising a single length of metal strip comprising a first helical section, a second non-helical section, and a third helical section, the end of either or both the first and third helical sections remote the second helical section being flared away from the longitudinal axis of the helix, the flaring being in the form of a section of spiral helix form.

4 Claims, 4 Drawing Sheets

PRIOR ART

PRIOR ART

HELICAL PRODUCTS AND METHOD OF MANUFACTURING OF SAME FOR ENGAGEMENT WITH A CABLE

FIELD OF THE INVENTION

This invention relates to helical products and methods of making such products.

BACKGROUND OF THE INVENTION

U.S. Pat. No. 5,927,125 describes methods and apparatus for manufacturing helical products and provides a discussion of earlier methods of making such products. The present application relates to particular products that can be made in helical form and discusses methods of using or adapting the apparatus and methods of U.S. Pat. No. 5,927,125 to making such products.

Helical devices as shown in U.S. Pat. No. 5,927,125 have some minor drawbacks. The first is that the free end of the helix can dig into optical cables when the cables are under tension and this is undesirable due to the relatively fragile nature of optical cables. The second drawback is that once the helical device is in place about a cable, whether optical or otherwise, it is difficult to get the free end of the helix away from the cable to unwind the helix. It is known with wire helical devices to flare the ends of a helix by forming the helix and then manually flattening its end in a press but, so far as the applicants are aware, such a method has not been used for metal strip helical devices.

GB 2303503 discloses, in the drawings only, flared ends to the helical strips. There is no disclosure as to the nature of this flaring nor as to how such flaring may be made.

GB 2308752 arguably shows a flared end to a helical unit. There is no disclosure as to the nature of the flaring end nor is there any disclosure as to the material of the helical unit.

GB 2234830 discloses a spiral helix used as a damper in which the helix "has an overall diameter which increases smoothly towards this end".

SUMMARY OF THE INVENTION

In a first aspect, the present invention provides a helical device for engagement with a cable, the helical device comprising a single length of metal strip comprising a first helical section, a second non-helical section, and a third helical section, the end of either or both the first and third helical sections remote the second helical section being flared away from the longitudinal axis of the helix, the flaring being in the form of a section of spiral helix form.

The inner surface of the helical sections may be knurled and it is advantageous that the knurling occupy only a part of the width of the strip material leaving the edges essentially free of knurling.

To produce these devices one may follow the steps of:

i) feeding strip material to an apparatus;

ii) within the apparatus automatically activating helix forming mean to form a first section of the strip material into the shape of a helix;

iii) within the apparatus automatically inactivating the helix forming means so as not to form a second section of the strip material into the shape of a helix;

iv) within the apparatus automatically activating the helix forming means to form the third section of the strip material into the shape of a helix;

v) selectively controlling the helix forming means to produce between helical sections of adjacent devices sections of increasing and then decreasing diameter, the strip being cut between the sections of increasing and then decreasing diameter, either prior or subsequent to the formation of the section of decreasing diameter, to provide the flared ends of the two adjacent devices; and vi) repeating steps i) to v) to produce further devices.

Further features of the invention will be apparent from the following description and the claims.

DETAILED DESCRIPTION OF THE DRAWINGS

Figure 1:
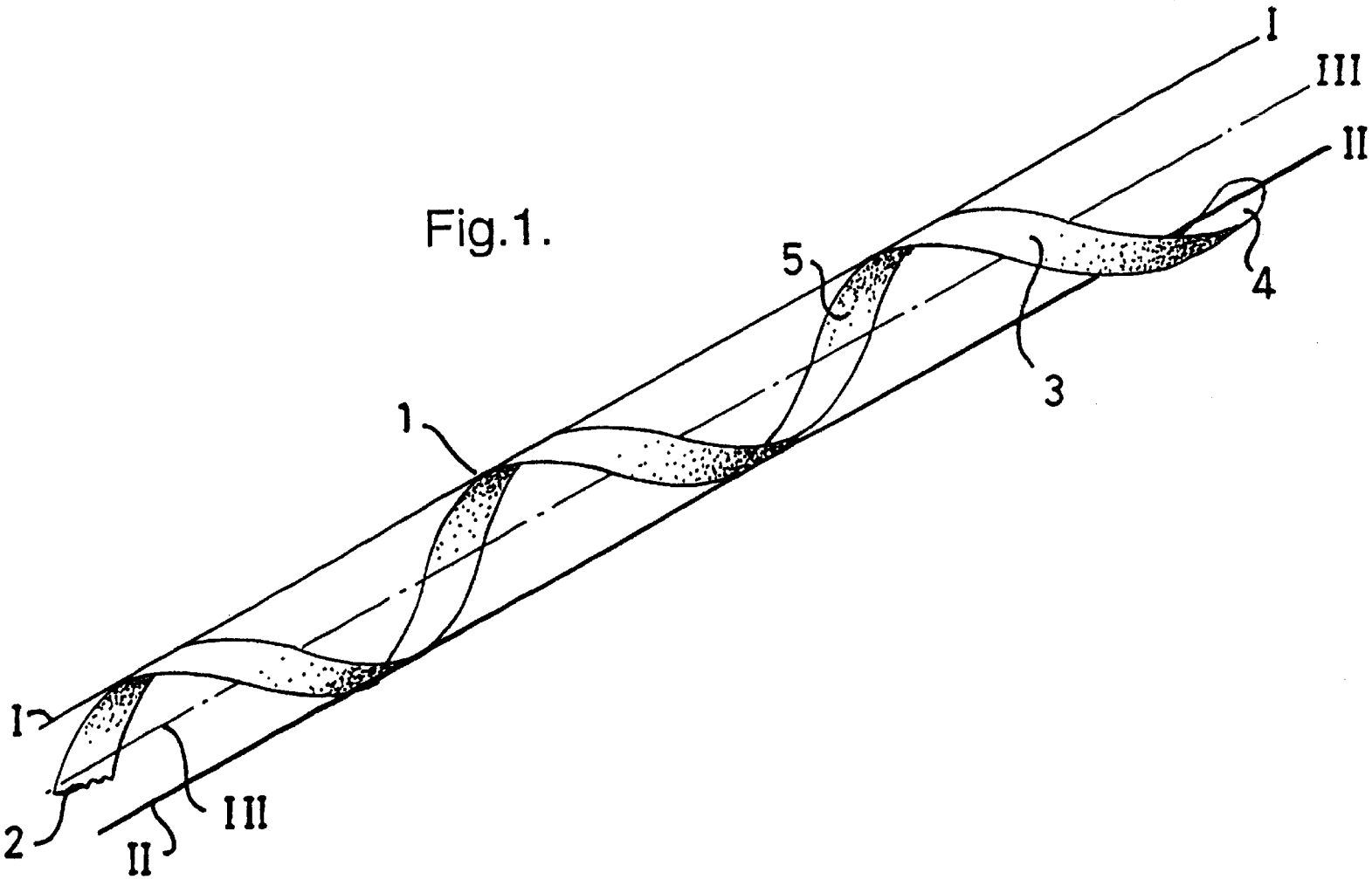
FIG. 1 is a perspective view of one embodiment of the helical product of the present invention.

In FIG. 1, a helical section 1 is shown of relatively constant pitch and diameter and lying between lines I—I and II—II.

End 2 of the helical section 1 is connected to other parts of the device not shown. The whole device may be of the general form shown in any of FIGS. 3–6.

The other end 3 of the helical section 1 is of spiral helix form being generally helical but of varying and increasing diameter so that it flares away from the longitudinal axis III—III of helical section 1.

The end of section 3 remote helical section 1 forms a tab 4. As the section 3 flares away from the longitudinal axis III—III of the helical section 1 it can be seen that it lies outside lines I—I and II—II so that the tab 4 cannot dig into a cable wound into the helical section 1.

Tab 4 will lie free of the surface of a cable wound into the helical section 1 and so it is relatively easy to get a digit or a tool under the tab to prize the helical section away from the cable.

Advantageously the inner surface of the helical section 1 is knurled and yet more advantageously the knurling occupies only a part of the width of the strip material leaving the edges essentially free of knurling (as indicated at 5 in FIG. 1). Knurling improves the grip of the helical section to the cable and by only occupying a portion of the width of the strip the edges of the strip are not rough and so will not abrade the surface of a cable when the helical device is engaged with the cable.

The helical devices may be formed, for example, by using apparatus capable of making helixes and of selectively varying the diameter of the helix during production of a single article so as to produce a flared end to a helix of a given diameter where it changes to a helix of a larger diameter. One such suitable apparatus is disclosed in U.S. Pat. No. 5,927,125 and described herein.

Figure 2:
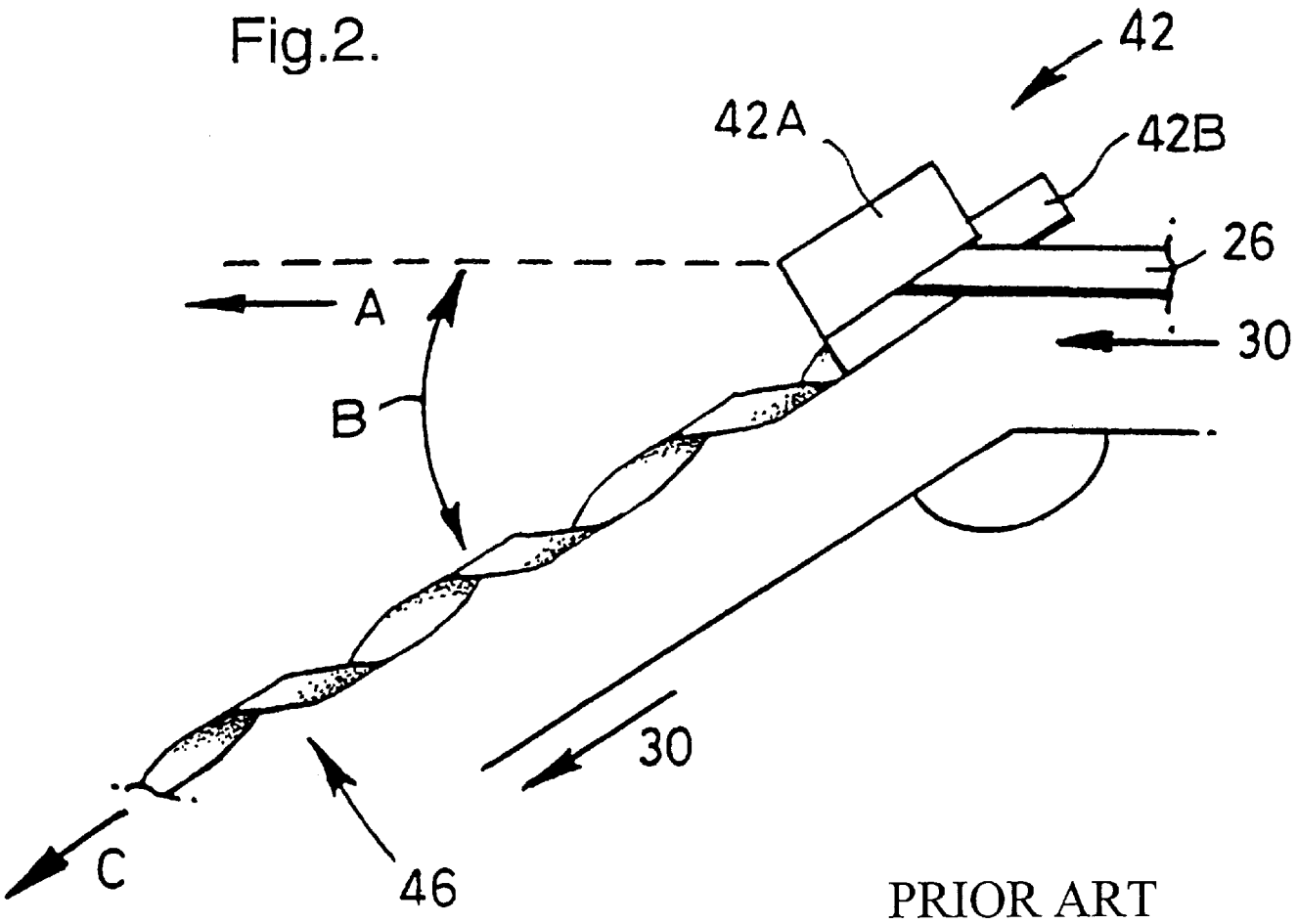
FIG. 2 is a schematic view of the apparatus disclosed in U.S. Pat. No. 5,927,125.

In FIG. 2, material 26 (albeit possibly knurled or otherwise marked) is delivered to the helical forming apparatus disclosed in U.S. Pat. No. 5,927,125. The material 26 encounters forming section 42, which includes a top forming roller 42A and bottom forming roller 42B having longitudinal axis C.

Forming rollers 42A and 42B impart a helical shape unto the material 26 passing therethrough by bending and twisting the material 26. The material 26 may be bent and twisted to form a variety of helical products, including those illustrated in FIGS. 3–6.

Figure 3:
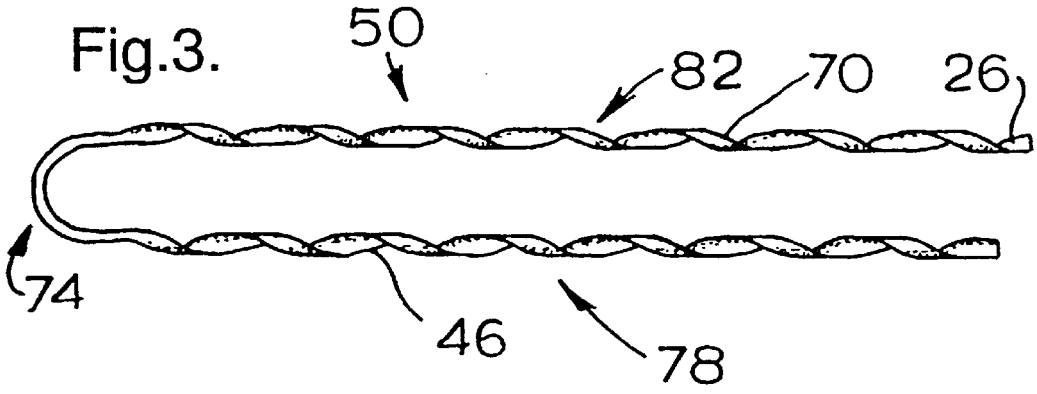
FIG. 3 is a side elevational view of a helical device disclosed in U.S. Pat. No. 5,927,125.

FIG. 3 illustrates a dead-end 50 which may be provided with a tab 4 according to the present invention. Dead-end 50 is formed of a continuous strip of material 26 and comprises helix 46, helix 70, and non-helical section 62. Non-helical section 62 of dead-end 50 has been curved (either manually or using other equipment) to form bight 74 and so that leg 78 (comprising helix 46) is approximately parallel to leg 82 (comprising helix 70).

Figure 4:
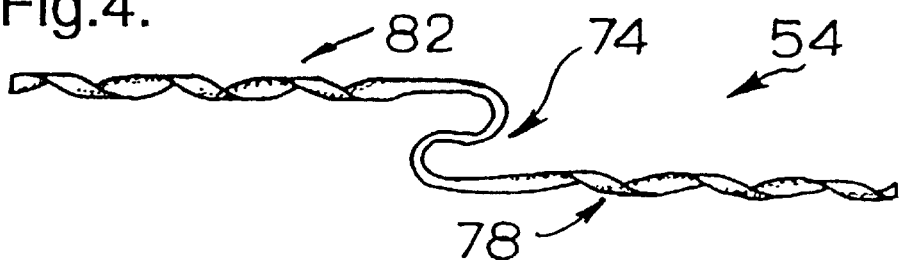
PRIOR ART Fig.4.
FIG. 4 is a top plan view of another helical device disclosed in U.S. Pat. No. 5,927,125.
Figure 5:
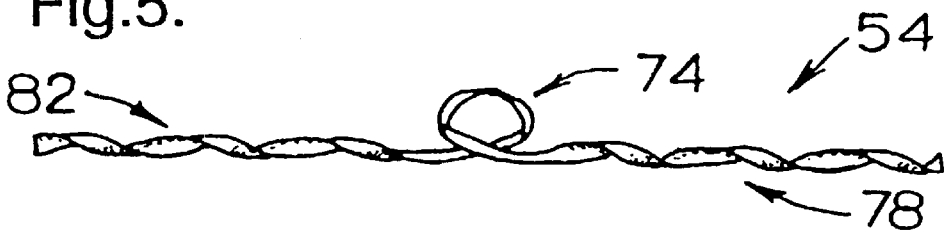
FIG. 5 is a side elevational view of the helical device of FIG. 4.
Figure 6:
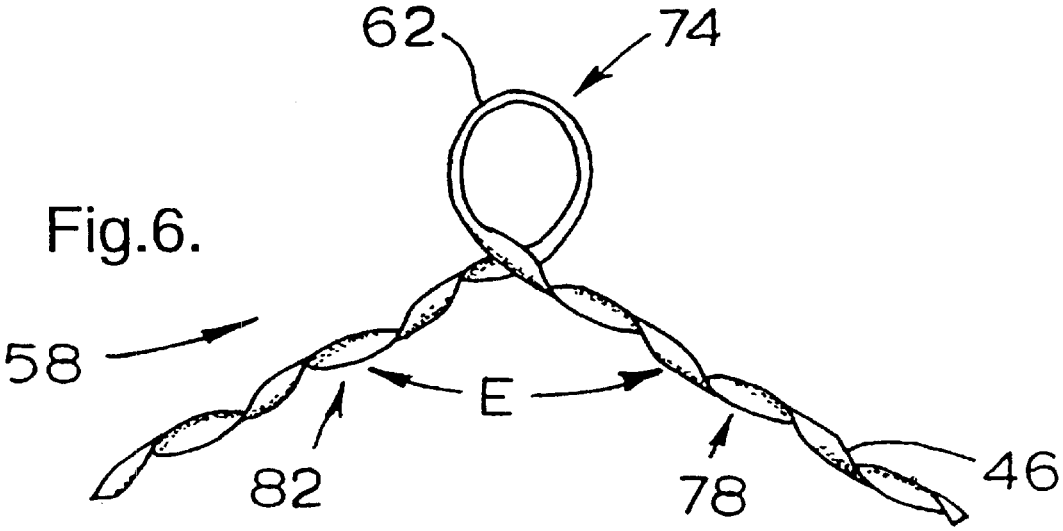
PRIOR ART Fig.6.
FIG. 6 is a front elevation view of yet another helical device disclosed in U.S. Pat. No. 5,927,125.

FIGS. 4 and 5 detail an exemplary insulator "top" tie 54 in which non-helical section 62 has been bent into bight 74 in the shape of an "S." The tie 54 may also be provided with a tab 4 according to the present invention. FIG. 6 shows an insulator "side" tie 58 which, again, may be provided with a tab 4 according to the present invention. In insulator tie 58, non-helical section 62 has been bent through approximately 300° to form bight 74. This produces a nominal angle E of approximately 120° between legs 78 and 82.

The distance between forming rollers 42A and 42B may determine the diameter of a helix formed in material 26 so that, helixes of different diameters may be formed merely by adjusting that distance. Rollers 42A and 42B simultaneously change the direction of travel of material 26 by an angle B, causing material 26 to range along longitudinal axis C rather than the original feed axis A. Thus, helixes 46 of different pitch lengths may be created by adjusting the angle B between longitudinal axis C and feed axis A. By connecting forming rollers 42A and 42B to suitable controlling equipment, moreover, adjustment may occur automatically.

Thus, the apparatus disclosed in U.S. Pat. No. 5,927,125 may be programmed to produce between helical sections of adjacent devices a section of increasing diameter. The succeeding device is then made by producing a section of decreasing diameter leading on to the helical section of the succeeding device.

Alternatively a section may be provided between adjacent helical devices comprising a section of increasing and then decreasing diameter, increasing from the diameter of the helical section and then decreasing to the diameter of the following helical section, this section being cut about the region of greatest diameter to provide the flared ends of the two devices. Preferably this section can comprise a pair of spiral helixes joined at their widest diameter directly, by a helix of constant diameter, or otherwise. Using such a method avoids the need to have a separate flattening step as used in relation to wire formed helical devices.

The apparatus of U.S. Pat. No. 5,927,125 is versatile and can be programmed as required and, as described in U.S. Pat. No. 5,927,125, variation of the pitch and diameter of a helix being formed can be selectively varied. As described above and shown in FIG. 2, a pair of rollers or other forming members 42A and 42B are used to bend and twist incoming strip material 26 to form a helix 46. By varying the angle and spacing of rollers 42A and 42B, the pitch and diameter of the helix can be varied as required even during the formation of a helix so that switching from a helix of constant diameter to a helical spiral of increasing diameter is straightforward.

The knurling can be applied by a separate knurling wheel in the apparatus or one of the forming members bending the strip to shape may comprise a knurling surface.

What is claimed is:

1. A helical device for engagement with a cable, the helical device comprising a single length of metal strip comprising a first helical section, a second non-helical section, and a third helical section, the end of either or both the first and third helical sections, remote the second non-helical section, being flared away from the longitudinal axis of the helix, the flaring being in the form of a section of spiral helix form.

2. A helical device for engagement with a cable, the helical device comprising a single length of metal strip comprising a first helical section, a second non-helical section, and a third helical section, the end of either or both the first and third helical sections, remote the second non-helical section, being flared away from the longitudinal axis of the helix, the flaring being in the form of a section of spiral helix form, wherein an inner surface of at least one of the helical sections is knurled across only a part of the width of the strip, the strip comprising at least one edge portion being essentially free of knurling.

3. A method of producing a helical device for engagement with a cable comprising:

i) feeding strip material to an apparatus;

ii) within the apparatus automatically activating helix forming means to form a first section of the strip material into the shape of a helix;

iii) within the apparatus automatically inactivating the helix forming means so as not to form a second section of the strip material into the shape of a helix;

iv) within the apparatus automatically activating the helix forming means to form a third section of the strip material into the shape of a helix;

v) selectively controlling the helix forming means to produce between helical sections of adjacent devices sections of increasing and then decreasing diameter, the strip being cut between the sections of increasing and then decreasing diameter, either prior or subsequent to the formation of the section of decreasing diameter, to provide the flared ends of the two adjacent devices; and vi) repeating steps i) to v) to produce further devices.

4. A method as claimed in claim 3 in which the sections of increasing and then decreasing diameter comprise a pair of spiral helixes joined at their widest diameter.

* * * * *